US007437118B2

(12) United States Patent
Ahn et al.

(10) Patent No.: US 7,437,118 B2
(45) Date of Patent: Oct. 14, 2008

(54) IMAGE FORMING APPARATUS WITH PRINTING MEDIUM GUIDE

(75) Inventors: Byung-sun Ahn, Suwon-si (KR); In-cheol Jeon, Yeongin-si (KR); Douk-soon Cha, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 274 days.

(21) Appl. No.: 11/270,573

(22) Filed: Nov. 10, 2005

(65) Prior Publication Data

US 2006/0104680 A1 May 18, 2006

(30) Foreign Application Priority Data

Nov. 12, 2004 (KR) ..... 10-2004-0092590
Nov. 18, 2004 (KR) ..... 10-2004-0094452

(51) Int. Cl.
*G03G 15/00* (2006.01)

(52) U.S. Cl. ..... 399/388

(58) Field of Classification Search ..... 399/388–396
See application file for complete search history.

(56) References Cited

U.S. PATENT DOCUMENTS 5,331,373 A * 7/1994 Nomura et al. ..... 399/111
2004/0258433 A1* 12/2004 Saito et al. ..... 399/111

FOREIGN PATENT DOCUMENTS

| | | | |
|---|---|---|---|
| JP | 62237480 A | * | 10/1987 |
| JP | 04-204871 | | 7/1992 |
| JP | 10-177286 | | 6/1998 |
| JP | 2001-075329 | | 3/2001 |

* cited by examiner

*Primary Examiner*—Ryan Gleitz
(74) *Attorney, Agent, or Firm*—Roylance, Abrams, Berdo & Goodman, L.L.P.

(57) ABSTRACT

An image forming apparatus has a photosensitive body on which an electrostatic latent image is formed. A developing unit develops the electrostatic latent image on the photosensitive body with a developer to form a developer image. The developer image on the photosensitive body is transferred onto an intermediate transfer belt in an intermediate transfer unit. The transfer unit transfers the developer image transferred on the intermediate transfer belt onto a printing medium. A cleaning unit cleans any developer remaining on the photosensitive body, and a printing medium guide unit is disposed on the cleaning unit to guide the printing medium until the printing medium enters the transfer nip between the intermediate transfer belt and the transfer unit.

17 Claims, 6 Drawing Sheets

IMAGE FORMING APPARATUS WITH PRINTING MEDIUM GUIDE

CROSS-REFERENCE TO RELATED APPLICATIONS

This application claims the benefit under 35 U.S.C. §119 (a) of Korean Patent Application No. 2004-92590, filed on Nov. 12, 2004, and Korean Patent Application No. 2004-94452, filed on Nov. 18, 2004, the entire contents of both of which are hereby incorporated by reference.

BACKGROUND OF THE INVENTION

1. Field of the Invention

The present invention relates to an image forming apparatus. More particularly, the present invention relates to an image forming apparatus with a guide unit to guide a printing medium to a transfer unit, with a plurality of photosensitive mediums and waste developer receptacles integrated into a single unit, and with waste developer receptacles with different volumes to compensate for different rates of developer usage.

2. Description of the Related Art

Generally, an electrophotographic image forming apparatus such as a laser printer forms an electrostatic latent image on a photosensitive medium such as a photosensitive drum or a photosensitive belt. The laser printer then develops the latent image with a toner of a certain color, and transfers the developed image onto a print medium to produce the desired image.

Japanese Patent Publication No. H04-204871, which is titled "Color Image Forming Apparatus," and which names Hiroshi Terada and Hidenori Kunishige as inventors, discloses an example of an image forming apparatus. The entire content of this publication is hereby incorporated by reference.

The image forming apparatus disclosed in Japanese Patent Publication No. H04-204871 comprises a plurality of rotatable photosensitive bodies. A plurality of developing means are disposed around the photosensitive bodies and develop images using toners of a plurality of different colors. The different color toner images are transferred to an intermediate transfer body, such as an endless belt, to form a full-color image. A transfer means transfers the color image on the intermediate transfer body to a transfer material (that is, a printing medium). A cleaning unit is included in the apparatus to clean any waste toner that remains on the photosensitive body.

Japanese Patent Publication No. H10-177286, which is titled "Image Forming Method and Apparatus Thereof," and which names Nobuyuki Yanagawa as an inventor, discloses another example of an image forming apparatus. The entire content of this publication is hereby incorporated by reference.

The image forming apparatus disclosed in Japanese Patent Publication No. H10-177286 includes an intermediate transfer belt that receives single color toner images from photosensitive drums to form a full-color image. The full-color image formed on the intermediate transfer belt is transferred by a transfer means to a transfer material (that is, a print medium). The image forming apparatus comprises a first image forming unit I and a second image forming unit II which are spaced at a certain distance along the intermediate transfer belt. The first image forming unit comprises a developing means that develops an electrostatic latent image on a photosensitive drum with an A color toner and a C color toner.

The second image forming unit comprises a developing means that develops an electrostatic latent image on a photosensitive drum with a B color toner and a D color toner (such as black).

Japanese Patent Publication No. 2001-75329, which is titled "Color Image Recording Apparatus," and which names Noboru Otaki as an inventor, discloses yet another example of an image forming apparatus. The entire content of this publication is hereby incorporated by reference.

The color image recording apparatus disclosed in Japanese Patent Publication No. 2001-75329 is a LED (Light Emitting Diode) type printer and comprises a pair of printing tools A and B. The printing tools A and B are parallel to each other and spaced a certain distance away from each other in the same horizontal plane so that they form a color image on a printing medium. The printing tool A forms images with Y (yellow) toner and M (magenta) toner, and the printing tool B forms images with C (cyan) toner and K (black) toner. An intermediate transfer procedure is performed by an intermediate transfer belt. That is, the color image is transferred onto a printing medium by a transfer means contacting the intermediate transfer belt.

These types of image forming apparatuses require a guide structure for guiding the printing medium to the transfer unit to increase transfer efficiency. Conventional guide structures, however, have a complicated structure and are difficult to manufacture.

The image forming apparatuses described above also employ a cleaning unit for removing any waste developer remaining on the photosensitive drum or the intermediate transfer belt.

The cleaning unit generally comprises a cleaning blade that contacts the surface of the photosensitive drum or the intermediate transfer belt to scrape off any waste developer remaining on the surface of the photosensitive drum or the intermediate transfer belt, and a waste developer receptacle.

As shown in these published applications, the photosensitive drum may be used to provide two different colors. In this case, a plurality of cleaning units may be used with each photosensitive drum. Also, when a plurality of the photosensitive drums are used, the photosensitive drums need to be precisely spaced apart from each other so that the color images are properly registered when they are transferred to the intermediate transfer medium. With existing systems, maintaining appropriate spacing can be difficult, resulting in improper registration and poor image quality.

Furthermore, in an image forming apparatus that uses a plurality of photosensitive drums, the amount of waste developer on a photosensitive drum that forms an electrostatic latent image of a monochromatic image, such as black, is greater than that of other colors. Thus, it may be necessary to replace the waste receptacle more often than desired.

Accordingly, there is a continuing need for an improved image forming apparatus. In particular, there is a need for an image forming apparatus with an improved paper guiding structure, with an improved structure for maintaining registration, and with an improved waste toner receptacle.

SUMMARY OF THE INVENTION

An aspect of the present invention is to address at least the above problems and/or disadvantages and to provide at least the advantages described below. Accordingly, an aspect of the present invention is to provide an image forming apparatus which guides a printing medium just before the printing medium moves into a transfer unit to improve transfer efficiency and has a simple guide structure to reduce manufacturing costs.

Another aspect of the present invention is to provide an image forming apparatus in which photosensitive bodies (photosensitive drums) and waste developer receptacles associated with the photosensitive bodies are integrally formed on a frame. With this construction, the distance between each photosensitive body can be precisely adjusted and the structure for handling waste developer can be simplified.

Yet another aspect of the present invention is to provide an image forming apparatus in which the waste developer receptacle associated with the photosensitive body with a larger developer consumption rate has a larger volume to minimize the frequency of replacement of the waste developer receptacle.

In accordance with an exemplary embodiment of the present invention, an image forming apparatus comprises a photosensitive body on which an electrostatic latent image is formed. A developing unit develops the electrostatic latent image on the photosensitive body with a developer to form a developer image. The developer image on the photosensitive body is transferred onto an intermediate transfer belt in an intermediate transfer unit. The intermediate transfer unit transfers the developer image on the intermediate transfer belt onto a printing medium. A cleaning unit cleans any waste developer remaining on the photosensitive body. A printing medium guide unit is provided at the cleaning unit to guide the printing medium until the printing medium enters a transfer nip between the intermediate transfer belt and the transfer unit.

The transfer unit and the photosensitive body may be on opposite sides of the transfer belt, and the cleaning unit may be formed at a side of the photosensitive body which is adjacent to a printing medium conveying path moving toward the transfer unit (that is, upstream of the transfer unit).

The printing medium guide unit may be formed at a side of the cleaning unit which is adjacent to the printing medium conveying path.

The printing medium guide unit may comprise a plurality of guide ribs formed on the cleaning unit. The guide ribs may be at a spaced distance from one another.

The shape of the printing medium guide unit may correspond to the shape of a gap between the side of the cleaning unit and a surface of the printing medium conveying path.

The photosensitive body may comprise first and second photosensitive drums which are spaced apart from another on the same vertical plane. The intermediate transfer belt may be an endless loop that rotates on an endless track in contact with the first and second photosensitive drums. The transfer unit may be rotatably mounted in contact with the lower exterior surface of the immediate transfer belt. First and second cleaning members to remove waste developer from the first and second photosensitive drums may be provided at each of the first and second photosensitive drums. The first and second waste developer receptacles may be mounted on the sides of each of the first and second photosensitive drums that correspond to the location of the first and second cleaning members. The printing medium guide unit may be mounted at a lower portion of the second waste developer receptacle to guide the printing medium until the printing medium enters the transfer nip between the transfer unit and the intermediate transfer belt.

The printing medium guide unit may comprise a plurality of guide ribs which are spaced apart from one another at a spaced distance on a lower portion of the second waste developer receptacle.

The shape of the printing medium guide unit may correspond to the shape of a gap between the side of the cleaning unit and a surface of the printing medium conveying path.

In accordance with another exemplary embodiment of the present invention, an image forming apparatus comprises a photosensitive body on which an electrostatic latent image is formed. A developing unit develops the electrostatic latent image on the photosensitive body with a developer to form a developer image. The developer image on the photosensitive body is transferred from the photosensitive body onto a printing medium by an intermediate transfer unit. A cleaning unit cleans any waste developer remaining on the photosensitive body. A printing medium guide unit is provided at the cleaning unit and guides the printing medium until the printing medium enters the transfer unit.

The printing medium guide unit may be formed at a side of the cleaning unit which is adjacent to the printing medium conveying path.

The printing medium guide unit may comprise a plurality of guide ribs formed on the cleaning unit. The guide ribs may be at a spaced distance from one another.

The shape of the printing medium guide unit may correspond to the shape of a gap between the side of the cleaning unit and a surface of the printing medium conveying path.

The photosensitive body may comprise a cylindrical photosensitive drum, and the intermediate transfer unit may comprise a cylindrical intermediate transfer drum.

In accordance with another exemplary embodiment of the present invention, an image forming apparatus comprises a photosensitive body on which an electrostatic latent image is formed. A developing unit develops the electrostatic latent image with a developer to form a developer image. A transfer unit transfers the developer image on the photosensitive body onto a printing medium. A cleaning unit cleans any waste developer remaining on the photosensitive body. A printing medium guide unit is provided at a side of the cleaning unit to guide the printing medium until the printing medium enters the transfer unit.

In accordance with another exemplary embodiment of the present invention, an image forming apparatus comprises at least two photosensitive bodies. A developing unit is provided around the photosensitive bodies to develop the electrostatic latent image with a developer into a visible image. A waste developer receptacle is provided for each of the photosensitive bodies to remove and collect developer remaining on the photosensitive bodies. The waste developer receptacle associated with the photosensitive body that has a greater developer consumption rate has a greater volume. The photosensitive bodies and the waste developer receptacle are integrally formed as a single unit in a photosensitive frame.

The developer with greater consumption may enable printing a monochrome image, and the developer may comprise a black developer.

BRIEF DESCRIPTION OF THE DRAWINGS

The above and other objects, features, and advantages of certain exemplary embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENTS

The matters defined in the description such as a detailed construction and elements are provided to assist in a comprehensive understanding of the exemplary embodiments of the invention. Accordingly, those of ordinary skill in the art will recognize that various changes and modifications of the exemplary embodiments described herein can be made without departing from the scope and spirit of the invention. Also, descriptions of well-known functions and constructions are omitted for clarity and conciseness.

In the following description, the terms "upstream" and "downstream" will be used with reference to the transfer direction of a printing medium.

Figure 1:
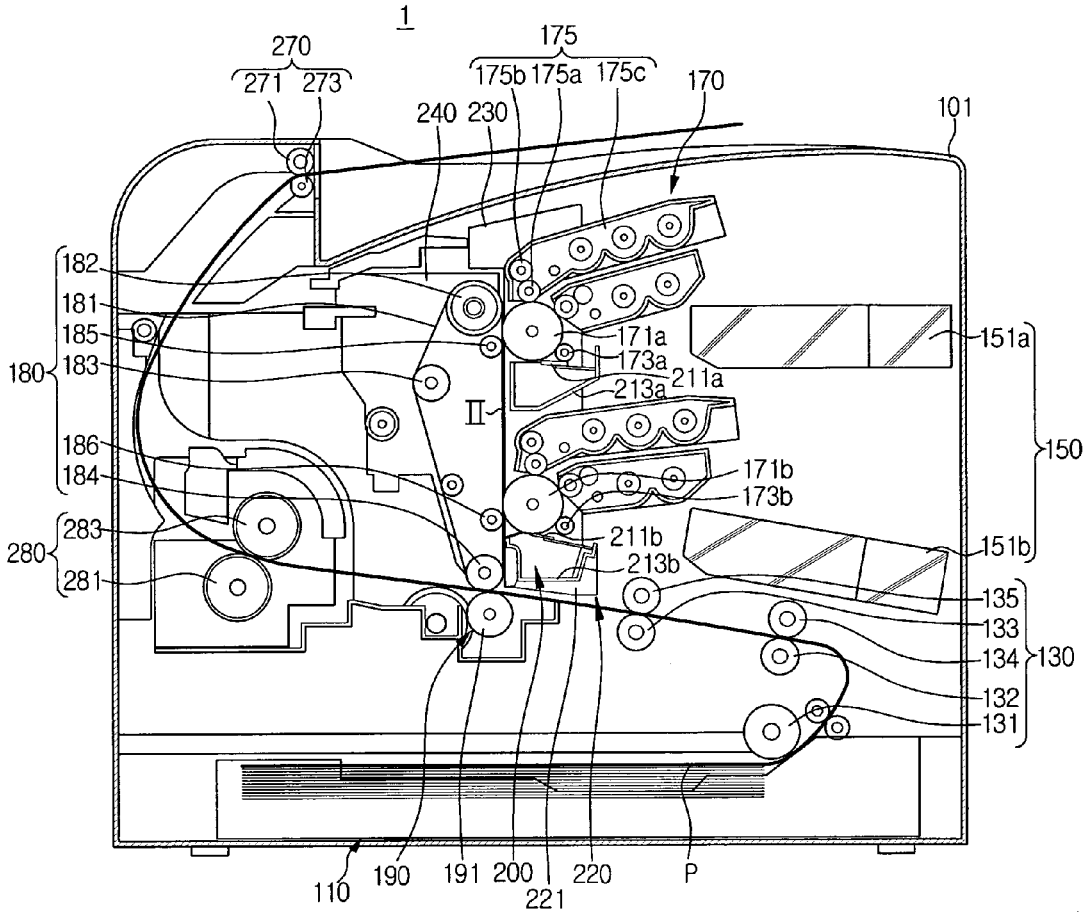
FIG. 1 is a schematic, sectional view of an image forming apparatus according to an exemplary embodiment of the present invention.

FIG. 1 is a vertical sectional view of a schematic construction of an image forming apparatus according to an exemplary embodiment of the present invention.

Referring to FIG. 1, an image forming apparatus 1 comprises a main body 101, a printing medium supply unit 110, a printing medium conveying unit 130, an optical scanning unit 150, an image forming unit 170, an intermediate transfer unit 180, a transfer unit 190, a fixing unit 280, and a printing medium discharge unit 270.

The printing medium conveying unit 130 conveys a plurality of sheets of printing medium P stacked in the printing medium supply unit 110 to the transfer unit 170. The printing medium conveying unit 130 comprises a pick-up roller 131 that picks up the printing medium P stacked in the printing medium supply unit 110 and first and second conveying rollers 132 and 133 and first and second conveying idle rollers 134 and 135 that convey the printing medium P picked-up by the pick-up roller 131.

The optical scanning unit 150 scans a light to form an electrostatic latent image on first and second photosensitive drums 171*a* and 171*b* (that will be described below). The optical scanning unit 150 comprises first and second optical scanning units 151*a* and 151*b*.

The image forming unit 170 uses the light scanned from the optical scanning unit 150 to form and develop an image to transfer onto the printing medium P. The image forming unit 170 comprises a photosensitive body (hereinafter described as the first and second photosensitive drums 171*a* and 171*b*), first and second charge rollers 173*a* and 173*b*, and a developing unit 175. The optical scanning units 151*a* and 151*b* irradiate the first and second photosensitive drums 171*a* and 171*b* to form an electrostatic latent image on the drums. The first and second charge rollers 173*a* and 173*b* contact the first and second photosensitive drums 171*a* and 171*b* to charge the first and second photosensitive drums 171*a* and 171*b*. The developing unit 175 is disposed around the first and second photosensitive drums 171*a* and 171*b* to develop the electrostatic latent image formed on the first and second photosensitive drums 171*a* and 171*b* with a certain developer to form a visible image, that is, a developer image. The photosensitive body may be a photosensitive drum or a photosensitive belt, or any other suitable type of photosensitive body known to a person skilled in the art.

The developing unit 175 develops an electrostatic latent image on the first and second photosensitive drums 171*a* and 171*b* using developers of different color to form a visible image. The developing unit 175 may have four sub-units for yellow, cyan, magenta, and black, respectively. Each sub-unit of the developing unit 175 comprises a developing roller 175*a*, a developer supply roller 175*b*, and a developer casing 175*c*, and two of the developing sub-units (such as those for yellow and cyan) may be provided to develop an electrostatic latent image on the first photosensitive drum 171*a* and another two of the developing sub-units (such as those for magenta and black) may be provided to develop an electrostatic image on the second photosensitive drum 171*b*.

The visible images, which are developed with each color by the developing unit 175 on the first and second drums 171*a* and 171*b*, are transferred onto an intermediate transfer belt 181. The intermediate transfer belt, which will be described in further detail below, is an endless loop which is driven in contact with the first and second photosensitive drums 171*a* and 171*b* so that a complete color image can be formed on the immediate transfer belt 221.

A cleaning unit 200 is disposed at one side of the first and second photosensitive drums 171*a* and 171*b* to clean waste developer remaining on the first and second photosensitive drums 171*a* and 171*b*. Preferably, the cleaning unit is formed at a side of the photosensitive body which is adjacent to a printing medium conveying path moving toward the transfer unit (that is, the upstream side of the photosensitive body). The cleaning unit 200 comprises a first cleaning blade 211*a* that removes a developer remaining on the surface of the first photosensitive drum 171*a*, and a first waste developer receptacle 213*a* that collects developer removed by the first cleaning blade 211*a*. Additionally, the cleaning unit comprises a second cleaning blade 211*b* that removes developer remaining on the surface of the second photosensitive drum 171*b*, and a second waste developer receptacle 213*b* that collects the developer removed by the second cleaning blade 211*b*.

The second waste developer receptacle 213*b* further comprises a printing medium guide unit 220 that guides the printing medium P until the printing medium P enters the transfer unit 190. A detailed description of the guide unit 220 will be provided below, with reference to FIGS. 4 and 5.

The intermediate transfer unit 180 comprises the intermediate transfer belt 181 which contacts the first and second photosensitive drums 171*a* and 171*b*, first, second and third rollers 182, 183 and 184 that support the intermediate transfer belt 181, and first and second intermediate transfer rollers 185 and 186 that are aligned with the first and second photosensitive drums 171*a* and 171*b* and contact the inside of the intermediate transfer belt 181. The intermediate transfer unit 180 may be a cylindrical drum instead of an intermediate transfer belt 181, as will be understood by those skilled in the art.

The first and second photosensitive drums 171*a* and 171*b* and the cleaning unit 200 are integrally formed with a photosensitive frame 230, and each of the components of the intermediate transfer unit 180 are also integrally formed with the intermediate transfer frame 240 as a single cartridge unit. A detailed description of the single cartridge unit will be provided below with reference to FIGS. 2 and 3.

The transfer unit 190 transfers a developer image formed on the image forming unit 170 onto the printing medium P, and comprises the transfer roller 191 opposed to the third roller 184, with the intermediate transfer belt 181 passing between the transfer roller 191 and the third roller 184.

The fixing unit 280 heats and presses the image transferred onto the printing medium P via the transfer unit 190 to fix the image, and comprises a heat roller 281 and a press roller 283.

The printing medium discharge unit 270 discharges the printing medium P with the fixed image from the fixing unit outside the main body 101. The printing medium discharge unit 270 comprises a discharge roller 271 and a discharge idle roller 273 corresponding to the discharge roller 271.

Figure 2:
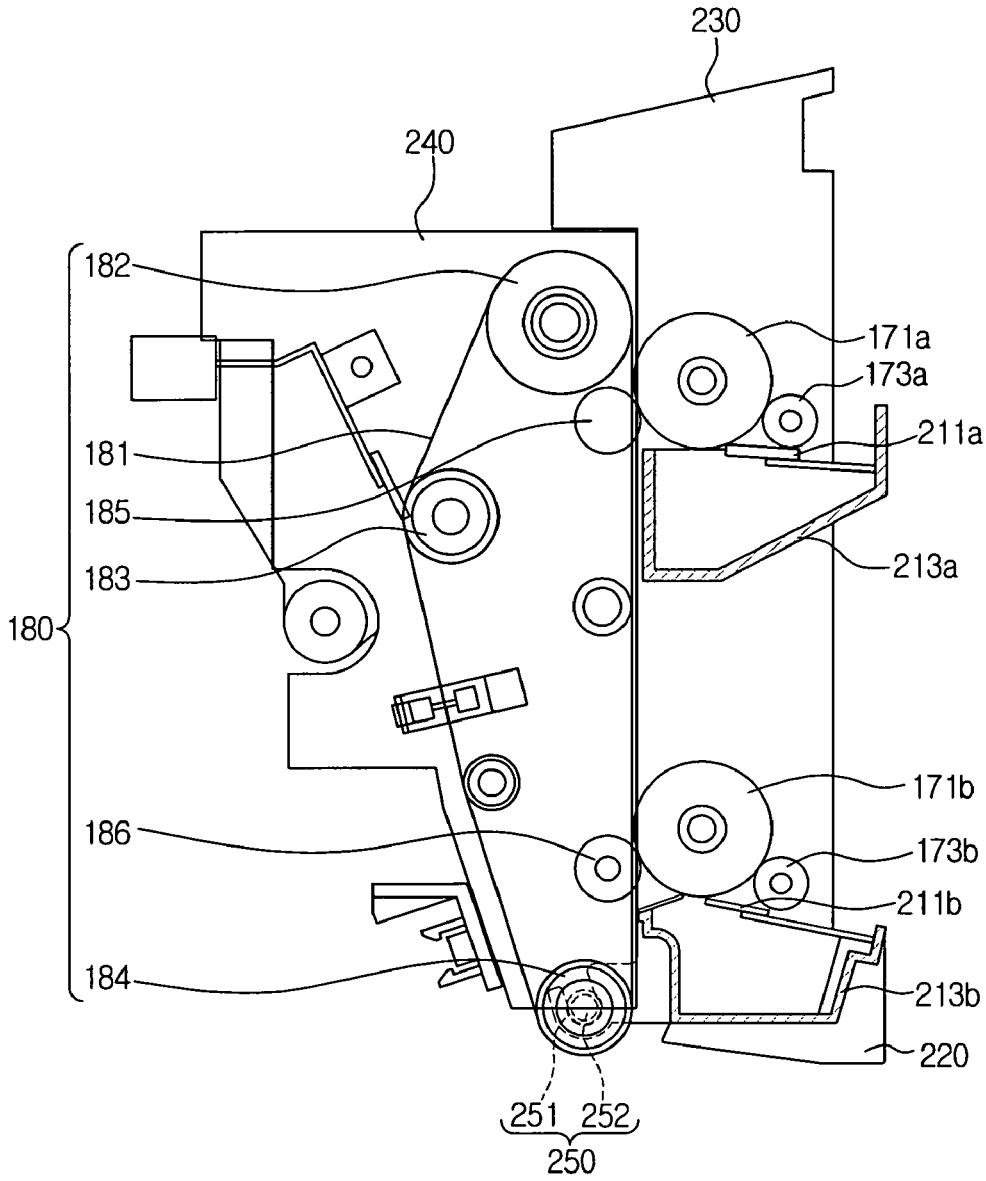
FIG. 2 is a plan view of an exemplary embodiment of an image forming unit and an intermediate transfer unit of FIG. 1 which are formed as a single cartridge unit.
Figure 3:
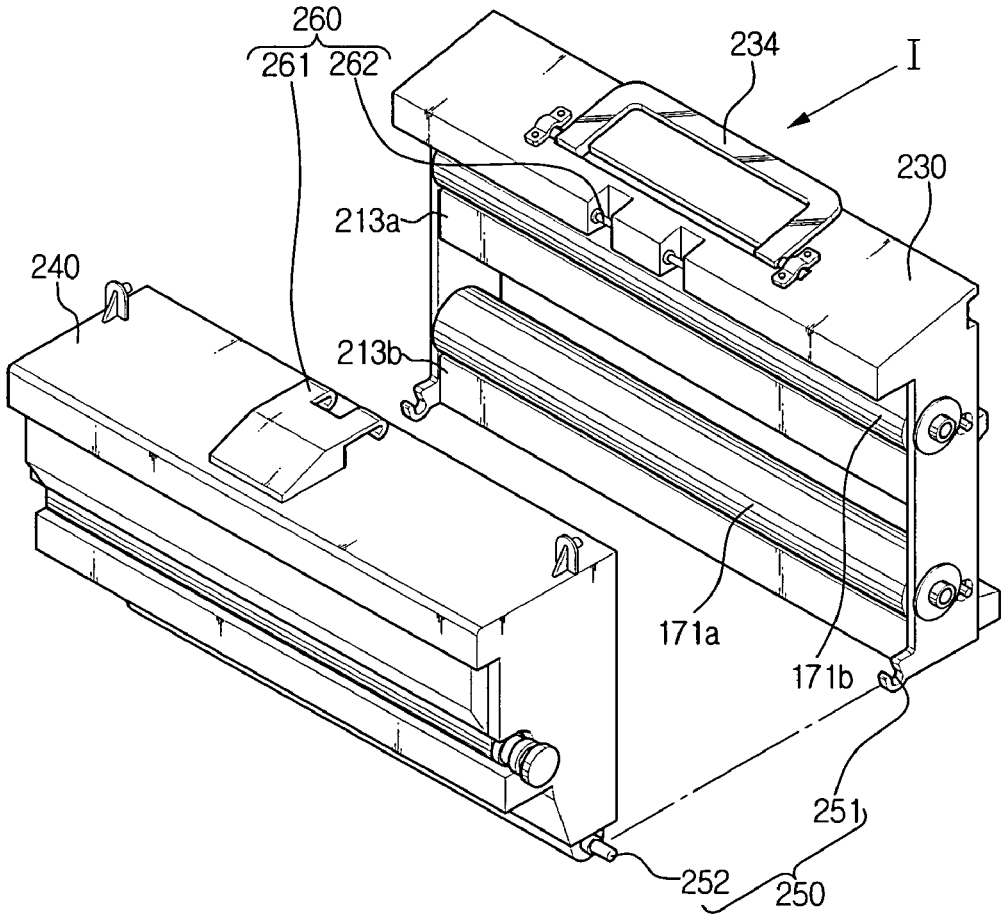
FIG. 3 is a perspective view of the exemplary embodiment of the single cartridge image forming unit and intermediate transfer unit of FIG. 2.

FIG. 2 is a plan view of an example of the image forming unit and the intermediate transfer unit of FIG. 1 being formed as a single cartridge unit, and FIG. 3 is a perspective view of an example of the image forming unit and the intermediate transfer unit of FIG. 1 being formed as a single cartridge unit.

Referring to FIGS. 2 and 3, the cartridge comprises the photosensitive frame 230, the intermediate transfer frame 240, a hinge unit 250, and a locking unit 260.

In the photosensitive frame 230, the first and second photosensitive drums 171*a* and 171*b*, the first and second charge rollers 173*a* and 173*b*, and the first and second waste developer receptacles 213*a* and 213*b* including the first and second cleaning blades 211*a* and 211*b*, are formed as a single unit. The cleaning member in the illustrated exemplary embodiment comprises first and second cleaning blades. One skilled in the art will recognize, however, that other types of cleaning members (such as brushes) can also be used.

In the intermediate transfer frame 240, the intermediate transfer belt 181, the first, second, and third rollers 182, 183 and 184, and the first and second intermediate transfer rollers 185 and 186 are formed as a single unit.

The hinge unit 250 connects the photosensitive frame 230 and the intermediate transfer frame 240 so that they can be engaged with and separated from each other. The hinge unit 250 comprises a hinge opening 251 formed at both sides of the photosensitive frame 230 and a hinge shaft 252 formed on the intermediate transfer frame 240 to correspond to the hinge opening 251.

The locking unit 260 maintains the engagement of the photosensitive frame 230 and the intermediate transfer frame 240. The locking unit 260 comprises a locker 261 formed at the intermediate transfer frame 240 and a locking protrusion 262 formed at the photosensitive frame 230 to correspond to the locker 261.

A handle 234 may be attached to a top surface of the photosensitive frame 230.

Referring back to FIG. 1, the photosensitive frame 230, in which the first and second photosensitive drums 171*a* and 171*b* and the cleaning unit 200 are integrally formed, and the intermediate transfer frame 240, in which the intermediate transfer unit 180 is integrally formed, together form a single cartridge unit. When the cartridge unit is detached from or attached to the main body, the cartridge unit may interfere with the developing unit 175. To avoid this, the developing unit 175 is preferably disposed move towards the side of the main body 101 where the first and second optical scanning units 151*a* and 151*b* are mounted when the cartridge unit is detached from or attached to the main body. For example, the cartridge unit may be moved when a front door (not shown) of the main body 101 is opened and closed.

The developing unit 175 is disposed to move in and out between the first and second optical scanning units 151*a* and 151*b*, which are spaced apart from each other so that the developing unit 175 does not interfere with the first and second optical scanning units 151*a* and 151*b*.

Figure 4:
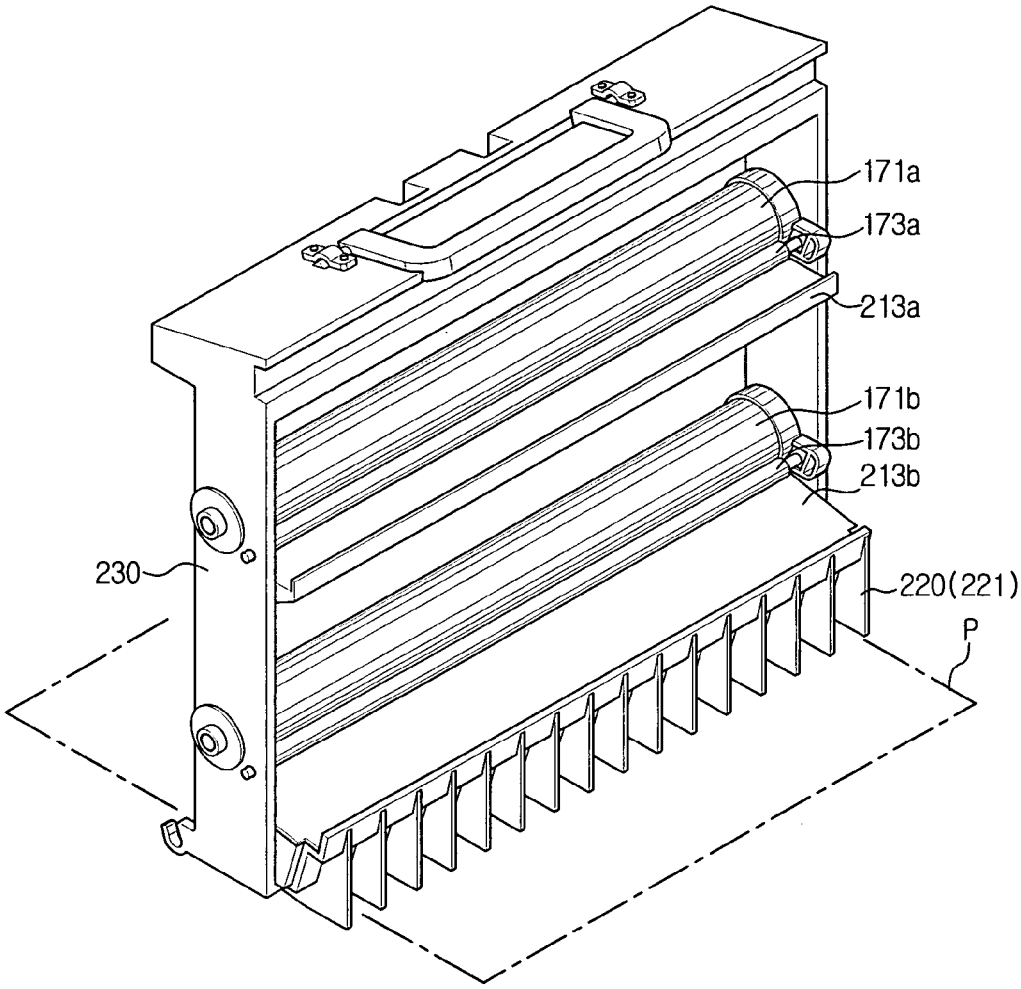
FIG. 4 is a perspective view of FIG. 3 in the direction of the arrow I in FIG. 3.
Figure 5A:
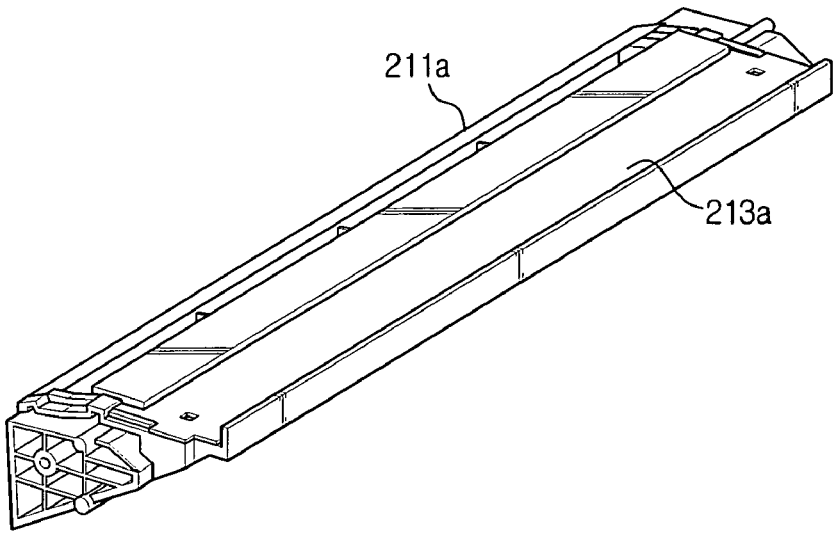
FIGS. 5A and 5B are perspective views of first and second waste developer receptacles according to an exemplary embodiment of the present invention.
Figure 5B:
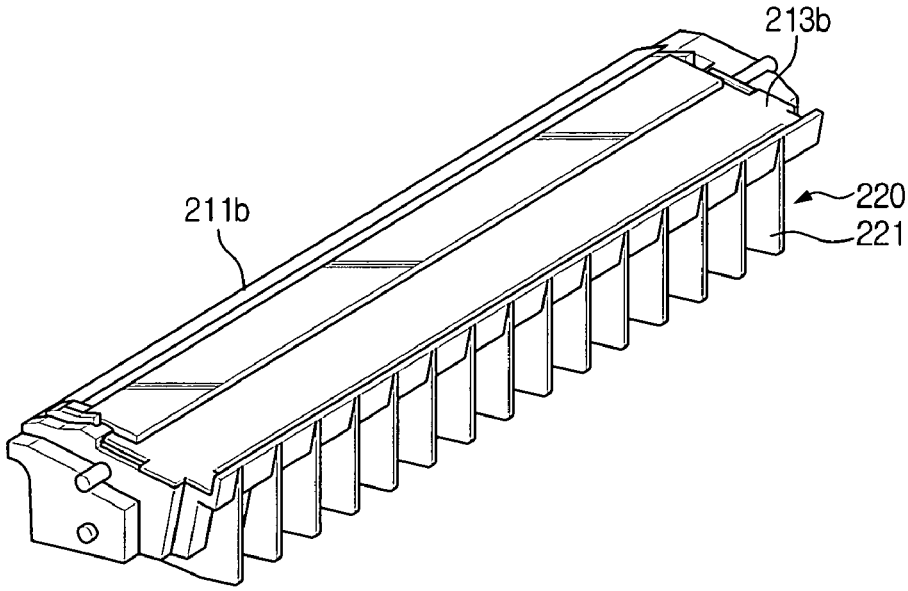
Figure 6A:
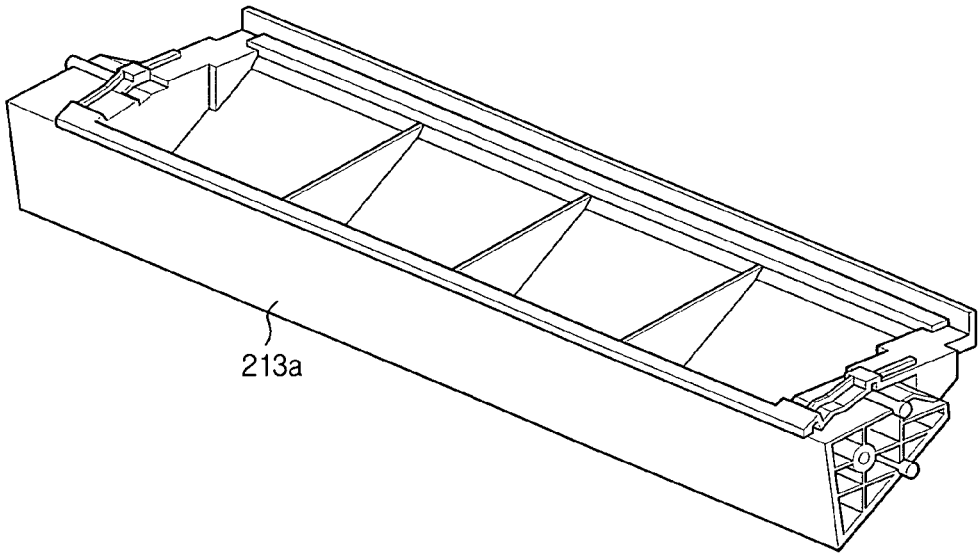
FIGS. 6A and 6B are perspective views of the first and second waste developer receptacles, in an opened state, according to an exemplary embodiment of the present invention.
Figure 6B:
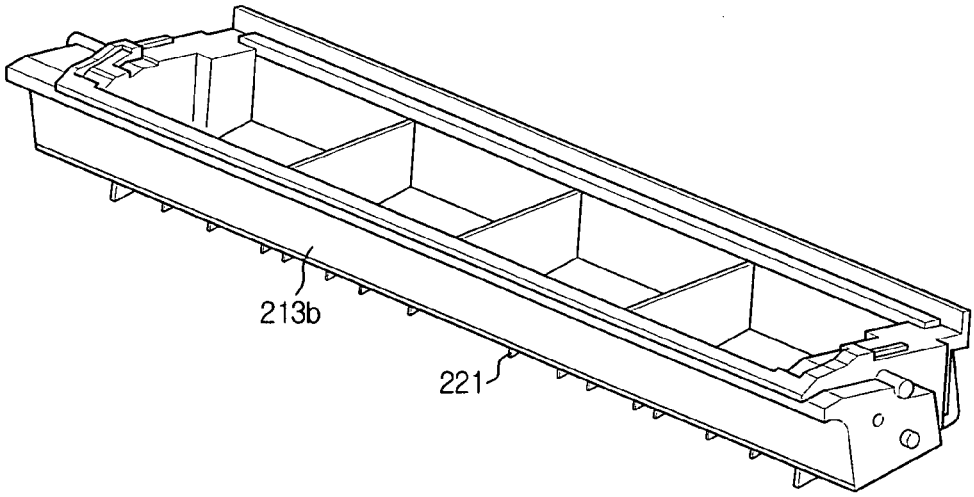

FIG. 4 is a perspective view of FIG. 3 in the direction of the arrow I in FIG. 1. FIGS. 5A and 5B are perspective views of first and second waste developer receptacles according to an exemplary embodiment of the present invention. FIGS. 6A and 6B are views of opened first and second waste developer receptacles according to an exemplary embodiment of the present invention.

Referring to FIGS. 5B and 6B, a plurality of guide ribs 221 are formed at a side of a second waste developer receptacle 213*b* as an example of the printing medium guide unit 220.

The guide ribs 221 are formed at a side of the second waste developer receptacle 213*b* that corresponds to the printing medium P conveying path. In the exemplary embodiment shown in FIGS. 5B and 6B, the guide ribs 221 are formed at a lower side of the second waste developer receptacle 213*b*.

As seen in FIG. 1, the guide ribs 221 fill the gap between the lower end of the second waste developer receptacle 213*b* and the surface of the printing medium P. In the illustrated exemplary embodiment, the lower ends of guide ribs 221 are inclined to conform to the travel path of the printing medium P.

With this structure, the guide ribs 221 stably guide the printing medium P until the printing medium P enters a transfer nip between the intermediate transfer belt 181 and the transfer unit 190 such that the transfer efficiency is increased. In other words, the guide ribs 221 prevent the printing medium P from moving upward when entering the transfer nip, and thus stably guide the printing medium P. Since the printing medium guide unit 220 is integrally formed with the second waste developer receptacle 213*b* instead of being formed as a separate structure, the construction of the image forming apparatus is simplified and the number of elements is reduced so that the manufacturing cost is lowered.

Because the second waste developer receptacle 213*b* is integrally formed with the first and second photosensitive drums 171*a* and 171*b* on the photosensitive frame 230, the interval between the printing medium guide unit 220 and the surface of the printing medium P is maintained at a regular interval.

In the above explanation, the guide ribs 221 are formed at the second waste developer receptacle 213*b*. The guide ribs 221, however, may be applied to all of the parts that are adjacent to the printing medium conveying path until entering the transfer unit 190.

The first and second waste developer receptacles 213*a* and 213*b* may have different volumes to compensate for different developer consumption by the corresponding developing sub-units. Generally, the second waste developer receptacle 213*b* corresponds to a developing sub-unit for outputting a monochrome (that is, black) image, and has a greater volume than the first waste developer receptacle 213*a*.

In the above-described exemplary embodiment, the developing sub-unit that uses a black developer is applied to the second photosensitive drum 171*b*, and the second waste developer receptacle 213*b* has a greater volume. The first waste developer receptacle 213*a*, however, may have a greater volume than the second waste developer receptacle 213*b*. Additionally, for convenience, black is used as an example of a monochrome image. A user may, however, may choose a different color.

Furthermore, in the above-described exemplary embodiment, an image is transferred to the transfer unit 190 to be transferred to the printing medium P via the intermediate transfer unit 180. The present invention is not limited to this particular exemplary embodiment, however, and the image may be directly transferred to the transfer unit 190 from a photosensitive body, without using the intermediate transfer unit 180.

The intermediate transfer belt 181 is arranged vertically in the illustrated exemplary embodiment, and the first and second photosensitive drums 171*a*, 171*b* are arranged vertically with respect to the transfer roller 191. Various other arrangements are also possible. For example, the intermediate transfer belt 181 may be arranged horizontally, and the first and second photosensitive drums 171*a*, 171*b* may be arranged on a plane surface of the horizontally arranged intermediate transfer belt.

According to the image forming apparatus 1 of the above exemplary embodiments of the present invention, a guide member is applied to guide the printing medium P until the printing medium P enters the transfer unit 190 such that the transfer efficiency can increase.

The photosensitive drums 171*a* and 171*b* and the cleaning unit 200 are formed as a single unit on the photosensitive frame 230, and the printing medium guide member is integrally formed with the cleaning unit such that the guide structure is simplified and manufacturing costs can be lowered.

The distance between each photosensitive drum can be precisely maintained and image quality can be improved since the photosensitive drums 171*a* and 171*b* and the cleaning unit 200 are formed as a single unit on the photosensitive frame 230.

Moreover, the waste developer receptacle that corresponds to the photosensitive drum with a greater developer consumption has a greater volume so that it is not necessary to frequently replace the waste developer receptacle.

While the invention has been shown and described with reference to certain exemplary embodiments thereof, it will be understood by those skilled in the art that various changes in form and details may be made therein without departing from the spirit and scope of the invention as defined by the appended claims.

What is claimed is:

1. An image forming apparatus, comprising:

a photosensitive body on which an electrostatic latent image is formed;

a developing unit that develops the electrostatic latent image on the photosensitive body with a developer to form a developer image;

an intermediate transfer unit having an intermediate transfer belt on which the developer image on the photosensitive body is intermediately transferred;

a transfer unit that transfers the developer image transferred on the intermediate transfer belt onto a printing medium;

a cleaning unit that cleans any developer remaining on the photosensitive body; and a printing medium guide unit disposed on the cleaning unit to guide the printing medium until the printing medium enters between the intermediate transfer belt and the transfer unit.

2. The image forming apparatus according to claim 1, wherein the transfer unit and the photosensitive body are on opposite sides of the transfer belt, and the cleaning unit is formed at a side of the photosensitive body which is adjacent to a printing medium conveying path moving toward the transfer unit.

3. The image forming apparatus according to claim 2, wherein the printing medium guide unit is formed at a side of the cleaning unit which is opposed to the printing medium conveying path.

4. The image forming apparatus according to claim 2, wherein the printing medium guide unit comprises a plurality of guide ribs formed on the cleaning unit.

5. The image forming apparatus according to claim 2, wherein the printing medium guide unit shape corresponds to a gap between the side of the cleaning unit and a surface of the printing medium conveying path.

6. The image forming apparatus according to claim 1, wherein the photosensitive body comprises a photosensitive drum.

7. The image forming apparatus according to claim 1, wherein the guide unit is integral with the cleaning unit.

8. An image forming apparatus comprising:

first and second photosensitive drums at a spaced distance in the same vertical plane, an intermediate transfer belt that drives on an endless loop in contact with the first and second photosensitive drums;

a transfer unit being rotatably mounted in contact with the lower exterior surface of the intermediate transfer belt;

first and second cleaning members to respectively remove waste developer from the first and second photosensitive drums;

first and second waste developer receptacles mounted respectively disposed adjacent to each of the first and second photosensitive drums to receive waste developer from the first and second cleaning members, the first and second photosensitive drums and the first and second waste developer receptacles being formed as a single unit on a single frame; and a printing medium guide unit disposed on a lower portion of the second waste developer receptacle to guide the printing medium until the printing medium enters a transfer nip between the transfer unit and the intermediate transfer belt.

9. The image forming apparatus according to claim 8, wherein the printing medium guide unit comprises a plurality of guide ribs on a lower portion of the second waste developer receptacle.

10. The image forming apparatus according to claim 8, wherein the printing medium guide unit shape corresponds to a gap between the surface of the cleaning unit and a surface of the printing medium conveying path.

11. An image forming apparatus comprising:

a photosensitive body on which an electrostatic latent image is formed;

a developing unit that develops the electrostatic latent image on the photosensitive body with a developer to form a developer image;

an intermediate transfer unit on which the developer image on the photosensitive body is intermediately transferred;

a transfer unit that transfers the developer image transferred on the intermediate transfer unit onto a printing medium;

a cleaning unit that cleans the developer remaining on the photosensitive body; and a printing medium guide unit, disposed on a surface of the cleaning unit that is opposed to a printing medium conveying path, and guiding the printing medium until the printing medium enters the transfer unit.

12. The image forming apparatus according to claim 11, wherein the printing medium guide unit is integral with the cleaning unit.

13. The image forming apparatus according to claim 11, wherein the printing medium guide unit comprises a plurality of guide ribs formed on the cleaning unit.

14. The image forming apparatus according to claim 11, wherein the printing medium guide unit shape corresponds to a gap between the side of the cleaning unit and a surface of the printing medium conveying path.

15. The image forming apparatus according to claim 11, wherein the photosensitive body comprises a cylindrical photosensitive drum.

16. The image forming apparatus according to claim 11, wherein the intermediate transfer unit comprises a cylindrical intermediate transfer drum.

17. An image forming apparatus comprising:

a photosensitive body on which an electrostatic latent image is formed;

a developing unit that develops the electrostatic latent image with a developer to form a developer image;

a transfer unit that transfers the developer image on the photosensitive body onto a printing medium;

a cleaning unit that cleans developer remaining on the photosensitive body; and a printing medium guide unit disposed on the cleaning unit to guide the printing medium until the printing medium enters the transfer unit.

* * * * *